United States Patent [19]

Nault

[11] 3,976,306

[45] Aug. 24, 1976

[54] ATTACHMENT FOR GROUND-ENGAGING PADS OF STABILIZERS

[76] Inventor: Harold Nault, 48 Beau St., Norwalk, Conn. 06880

[22] Filed: Feb. 26, 1975

[21] Appl. No.: 553,328

[52] U.S. Cl. ..... 280/763; 212/145; 214/138 R

[51] Int. Cl.[2] ..... B60S 9/00; B66C 23/80

[58] Field of Search ..... 214/138; 280/150.5, 280/14, 475, 477; 254/86 R; 105/368 S; 212/145; 248/357, 188.8, 188.9

[56] References Cited

UNITED STATES PATENTS

| | | | |
|---|---|---|---|
| 2,405,578 | 8/1946 | Holmes | 212/145 |
| 3,079,009 | 2/1963 | Davis | 212/145 |
| 3,534,877 | 10/1970 | Menzi | 212/145 |
| 3,721,458 | 3/1973 | Mitchell | 280/150.5 |

*Primary Examiner*—Robert J. Spar
*Assistant Examiner*—Lawrence J. Oresky

[57] ABSTRACT

An attachment for ground-engaging pads of stabilizer arms of material-handling apparatus. The pad has a ground-engaging plate and at least one bracket normal with respect to the ground-engaging plate which is welded or otherwise rigidly secured thereto. The bracket (or a pair of brackets) is pivotally connected to the free end of the stabilizer arm in a conventional manner. The ground-engaging plate has a recess and an opening. A rough-terrain engaging attachment is adapted to be mounted on the pad by having a portion projecting through said opening in the plate and engaging the plate at the recess. A pin is removably mounted in the projecting portion of the attachment for holding the attachment in operating position on the pad, so that when the pin is removed, the attachment can be easily dismounted from the ground-engaging pad.

4 Claims, 6 Drawing Figures

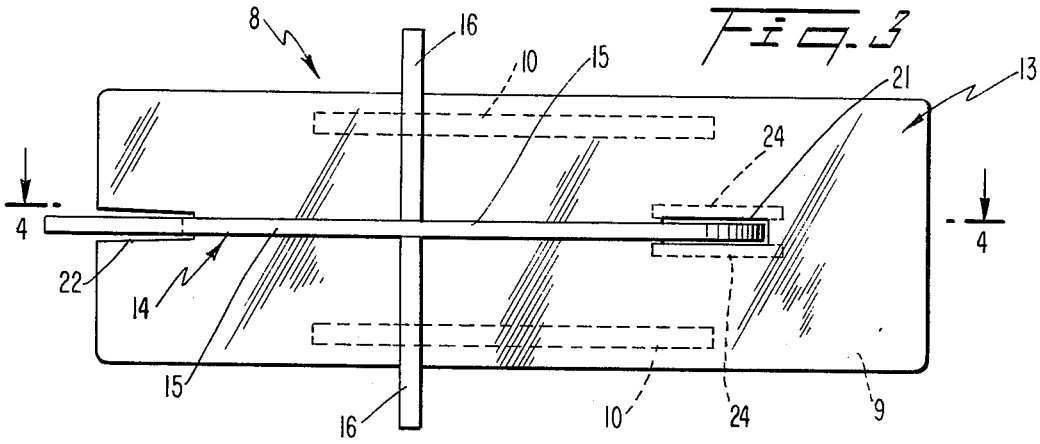
Fig. 3
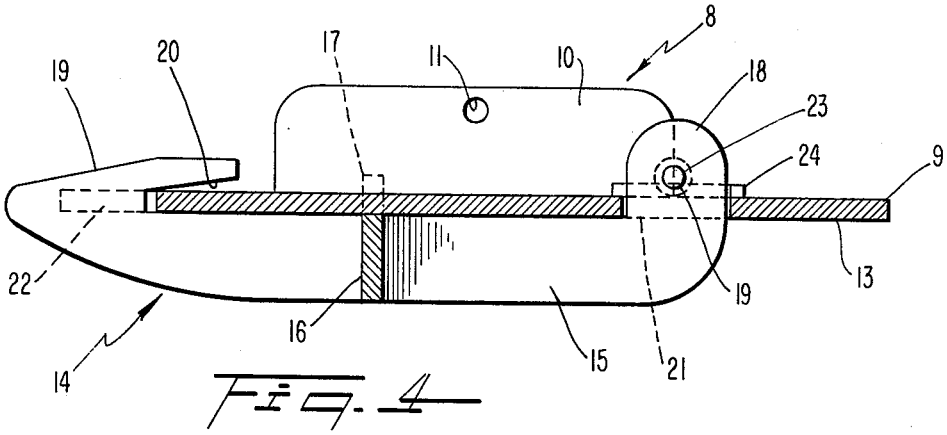
Fig. 4
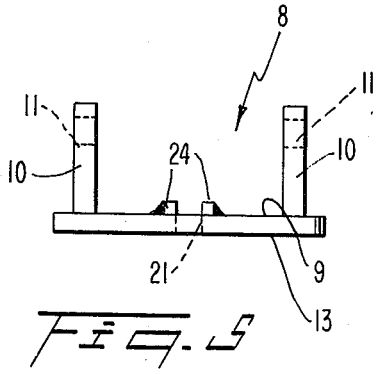
Fig. 5
Fig. 6
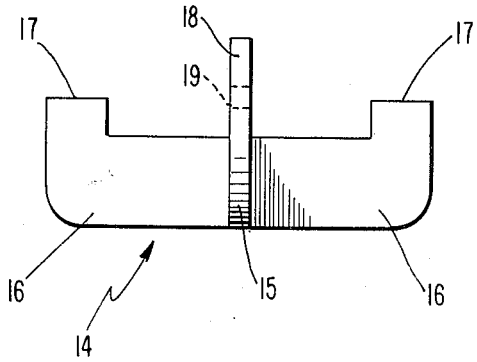

ATTACHMENT FOR GROUND-ENGAGING PADS OF STABILIZERS

BACKGROUND OF THE INVENTION

The present invention relates to attachments for pads of stabilizers for vehicles and, more particularly, to attachments for stabilizer pads for mobile machinery such as vehicle-mounted back hoes, cranes, shovels or the like.

Conventionally, some types of material-handling apparatus are mounted on vehicle chassis to facilitate movement of the material-handling equipment from one site of a work operation to the next. The vehicle on which the material-handling machine is mounted is usually in the form of a tractor and the machine includes a mounting frame to which is pivoted a swing frame or boom which is also pivoted on a vertical axis for lateral swinging movement relative to the mounting frame of the vehicle. Material-handling or holding means, such as buckets or other implements, are usually carried by the swing frame, or boom, for movement therewith.

Generally, the wheel base of the ground-engaging wheels of the tractor does not provide sufficient stability for the machine, when the machine is in working position. This is particularly true in earth-moving machinery, such as shovels or back hoes, which are adapted to pick up a load in an extended position of the boom relative to the frame of the machinery and the vehicle, and to raise the load and carry the load to a place of disposal, likewise remote from the vehicle. This is accomplished by swinging movement of the swing frame, or boom, of the machine. Since the swinging frame, or boom, of the machinery is usually swingable along an arc subtending approximately 180°, the swinging frame, when loaded, tends to unbalance the vehicle, causing the vehicle and machine to be tipped over if no further stabilizing means are provided.

The conventional stabilizing means, particularly for back hoes or other earth-moving machinery, comprise stabilizing arms adapted to be extended from the vehicle or from the frame of the machine. These stabilizing arms are conventionally pivotally mounted about a horizontal axis as well as about a vertical axis and are thus swingable for both vertical and horizontal swinging movement. The stabilizer arms are provided at their free ends with pivotally movable ground-engaging pad members for supporting the stabilizer assembly upon the ground surface when the earth-moving machinery is in an operating position. The stabilizer pad member conventionally comprises a pair of integral or welded brackets which have a pair of holes for receiving a pivot pin. These stabilizer pad members are pivotally connected to the free ends of the stabilizer arms by means of the aforementioned pins. Such pad members have ground-engaging surface which is suitable for contacting only one particular type of ground surface or terrain. When the material-handling apparatus is moved from one construction site to another having a different type of terrain, then it is usually necessary to exchange one type of pad member for another type of pad member adapted to properly engage the new type of terrain found at the new construction site. The major material-handling apparatus manufacturers thus sell a line of ground-engaging pad members which include generally at least 5 different types of pad members. Thus the operator of a material-handling apparatus, such as a back hoe, must purchase 5 different types of ground-engaging pad members for his material-handling machine in order to provide the necessary versatility to the machine to operate in all types of terrain. These various types of stabilizer pad members are not only costly but the dismounting and replacing of such stabilizer pad members from the stabilizer arms is quite time-consuming.

SUMMARY OF THE INVENTION

The present invention provides an attachment or utensil for ground-engaging pads of stabilizers of material-handling apparatus which can be easily mounted on the pad member, thereby changing the ground-engaging characteristics of the pad member and avoiding the necessity of exchanging pairs of ground-engaging pad members.

The attachment or utensil for ground-engaging pads of stabilizer arms of material-handling apparatus of the present invention comprise at least one portion adapted to project through an opening in the pad member and another portion which engages the pad member. The projecting portion of the attachment has a bore through which a retaining pin may be inserted. The retaining pin bears against the upper surface of the pad member and thereby maintains the ground-engaging attachment in position on the pad member. Thus, for example, a pad member adapted to engage and contact a smooth terrain can be easily transformed into a rough-terrain-engaging pad member by mounting the attachment or utensil of the present invention on the pad member already mounted on the stabilizer arms of the material-handling apparatus. Thus the pad members mounted on the stabilizer arms do not need to be dismounted when the material-handling apparatus is moved from a construction site having a smooth terrain to another construction site having a rough terrain or vice-versa. The existing pad members can be easily converted for purposes of receiving the ground-engaging attachment or utensil of the present invention by adding at least one slot and one opening to the plate of the ground-engaging pad, the projecting portion of the attachment or utensil being adapted to be inserted through the opening in the plate of the ground-engaging pad.

The advantages and novel features of the present invention will become more apparent by reference to the following detailed description in connection with the appended drawings illustrating a preferred embodiment thereof.

BRIEF DESCRIPTION OF THE DRAWINGS

The preferred embodiment of the invention is illustrated in the accompanying drawings forming part of the detailed description and in which:

FIG. 3 is a bottom plan view of the stabilizer pad member and attachment of the present invention;

FIG. 4 is a cross-sectional front elevational view along line 4—4 of FIG. 3;

FIG. 5 is a side elevational view of the stabilizer pad member; and

FIG. 6 is a side elevational view of the attachment for the stabilizer pad member.

DESCRIPTION OF THE PREFERRED EMBODIMENT

Figure 1:
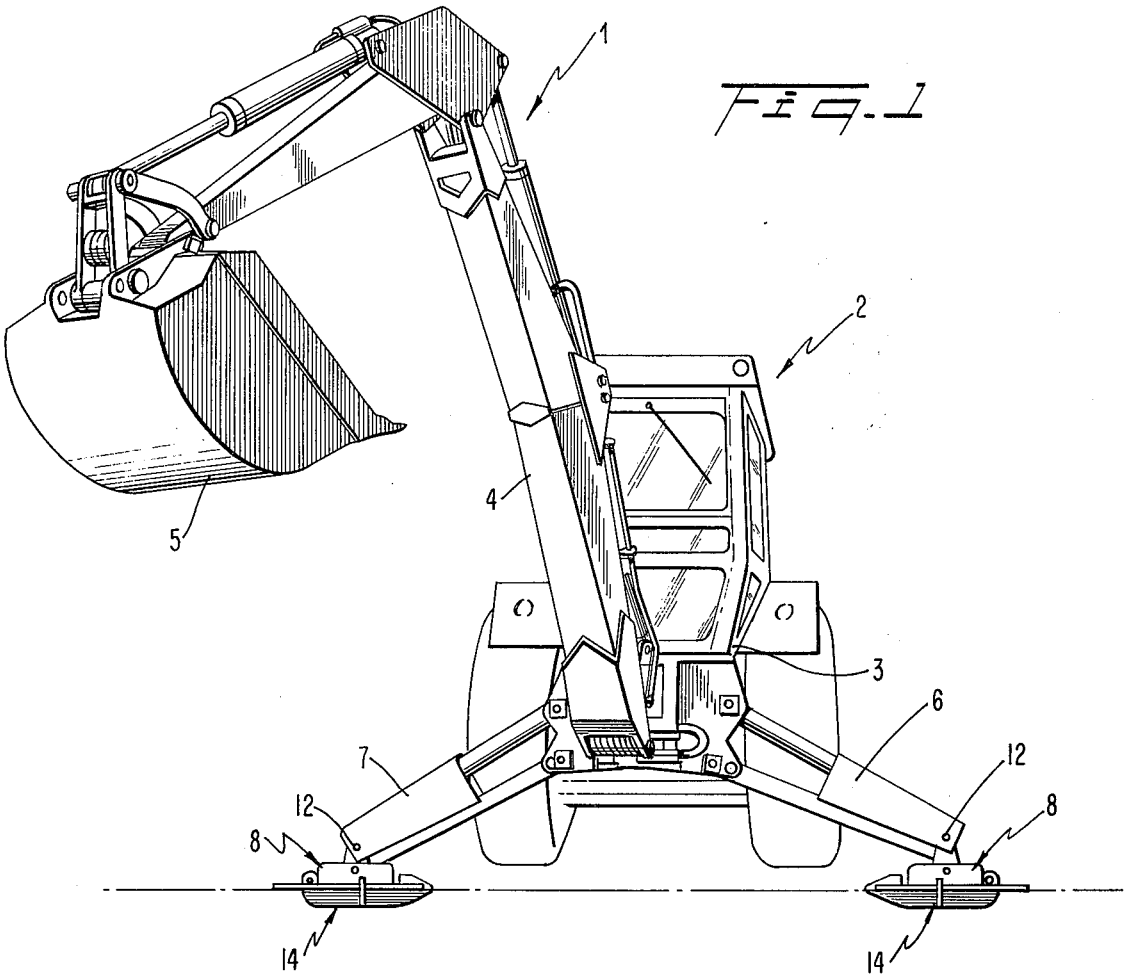
FIG. 1 is a perspective illustration of an earth-moving equipment, including a tractor vehicle and a back hoe attached thereto, provided with stabilizer arms and pad members having the attachments of the present invention.
Figure 2:
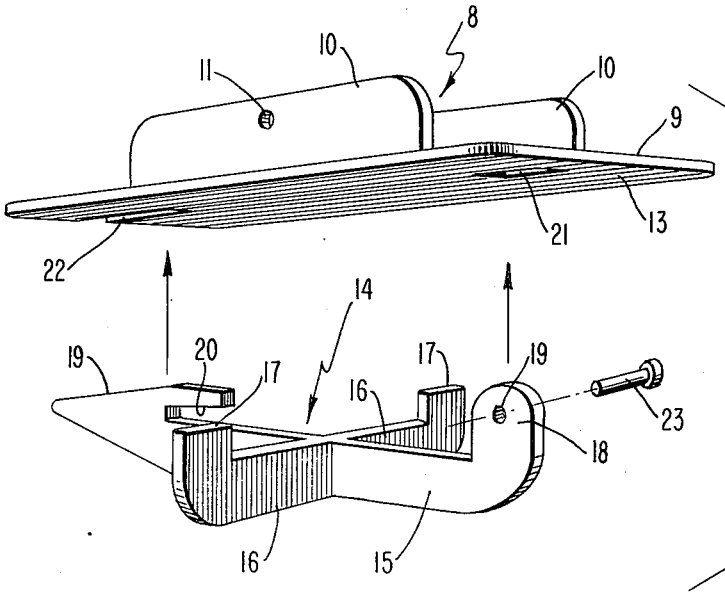
FIG. 2 is a detailed explosive view in perspective of a stabilizer pad member and attachment of the present invention.

With reference now to FIG. 1 of the drawings, an earth-moving machine, such as a back hoe, indicated generally as 1, is shown attached to a vehicle, such as a tractor 2. The earth-moving machine, generally, consists of a frame 3 forming part of the tractor on which a swinging frame assembly 4 having a load-handling device, such as a bucket 5, is mounted for swinging movement about a horizontal as well as about a vertical axis.

A pair of stabilizing arm assemblies 6 and 7, respectively, are pivotally attached to the side of the machine frame 3 for stabilizing the machine on the ground when the machine is in a working position. Normally, the stabilizer arm assemblies 6 and 7 extend from the lateral sides of the frame 3 adjacent the pair of wheels of the tractor vehicle 2 in a direction substantially normal to the longitudinal center line of the vehicle 2, and protrude outwardly to a point beyond the dimension of the wheel base of the tractor vehicle 2. Each of the stabilizer arm assemblies 6 and 7 is identical in construction, and, therefore, the features of the present invention will be described in connection with only one stabilizer arm assembly, it being understood that the same novel features and constructional arrangement apply likewise to the other stabilizer arm assembly at the other side of the vehicle or machine. The stabilizer arm assemblies 6 and 7 have at their free end stabilizer pad members 8 which are pivotally mounted at the free ends of the stabilizer arms 6 and 7.

Referring now to FIGS. 2–6 of the drawings, there is illustrated a stabilizer pad member 8 which comprises a ground-engaging plate 9 to which there are rigidly secured a pair of brackets 10, said brackets either being integral with the plate 9 or being welded thereto. Each bracket 10 of the pair of brackets has a hole 11, said holes 11 being aligned so that a pin 12 can be inserted therethrough, said pin being part of the pivotal connection between the stabilizer arm assemblies 6 and 7 and the stabilizer pad members 8.

As can be clearly noted from FIGS. 4 and 5, the pair of brackets 10 are normal with respect to the plate 9. Therefore, pin 12 can be easily inserted through the holes 11 and corresponding holes at the free ends of the stabilizer arm assemblies 6 and 7. The stabilizer pad members 8 can therefore be dismounted from the stabilizer arm assemblies 6 and 7 by moving the pins 12.

The stabilier pad member 8 has a substantially smooth bottom surface 13 which is adapted to contact a relatively smooth terrain and thus stabilize the earth-moving machinery on this smooth terrain when it is in operation.

When the earth-moving machinery is moved to a construction site having a rough terrain, it is necessary that the stabilizer pads be of such construction and configuration that they can stabilize the earth-moving machinery on this rough terrain while in operation. For this purpose, the present invention includes an attachment 14 which includes a main member 15 and a second cross-member 16 normal with respect to the member 15 and integral therewith. It is also possible to weld two seperate halves, forming the cross-member 16, to the main member 15. The cross-member 16 has two upwardly projecting portions 17 which are sufficiently spaced from each other to permit the plate 13 to be inserted therebetween. The main member 15 has a projecting portion 18 in which there is located a hole 19. At the other end of the main member 15 there is provided a V-shaped portion 19 in which a V-shaped slot 20 is located, said slot 20 having at its mouth a width which is slightly larger than the thickness of the plate 9.

The plate 9 is provided with an elongated opening 21 and a slot 22. The length and width of the elongated opening 21 are slightly larger than the corresponding length and width of the projecting portion 18 so that this projecting portion 18 of the main member 15 can be easily inserted through the opening 21. The slot 22 in plate 9 is slightly shorter than the slot 20 in the main member 15.

The attachment is mounted on the stabilizer pad member 8 by first hooking or interdigitating the V-shaped end 19 of the main member 15 onto the plate 9 via the slots 20 and 22 as illustrated in FIG. 4. Thereafter, the attachment 14 is pivoted upwardly so that the projection 18 is moved through the opening 21. After the attachment 14 has been correctly situated relative to the stabilizer pad member 8, a pin 23 is inserted through the hole 19 and maintains the attachment 14 in an operative position on the stabilizer pad member 8. A pair of supporting lips 24 can be welded on the upper side of the plate 9 along the longitudinal edges of the slot 21 for supporting the pin 23 and to facilitate the removal of the pin 23.

After the attachment 14 has been correctly positioned onto the stabilizer pad member 8, the main member 15 and cross-member 16 act jointly to firmly engage a rough terrain, such as, for example, a rocky excavation site, and thereby stabilize the earth-moving machinery 2 on such rocky terrain.

Although the invention is illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. An attachment for ground-engaging pads of stabilizer arms of material-handling apparatus, comprising said ground-engaging plate having an opening, said ground-engaging plate having at least one bracket projecting therefrom and being adapted to be pivotally conected to the free end of a stabilizer arm, and attachment having a projecting portion adapted to extend through said opening toward said stabilizer arm, and retaining means adapted to be operatively and removably mounted on said projecting portion for maintaining said attachment in operative position on said plate, the ground-engaging characteristics of the ground-engaging pad being substantially different when said attachment is operatively mounted thereon; said attachment comprises a main member having said projecting portion and a first slot, said plate having a second slot, said first and second slot interdigitate with each other when said main member is mounted on said plate.

2. The attachment for ground-engaging pads of stabilizer arms of material-handling apparatus as set forth in claim 1, wherein said ground-engaging plate has a pair of brackets arranged normal with respect to said plate and welded thereto, said pair of brackets has a pair of aligned holes adapted to receive a first pin which forms part of the pivotal connection between the free end of the stabilizer arm and the ground-engaging pad.

3. The attachment for ground-engaging pads of stabilizer arms of material-handling apparatus as set forth in claim 1, including a cross-member rigidly secured to said main member and projecting laterally therefrom, said projecting member having an opening adapted to receive a second pin for maintaining said attachment on said plate.

4. The attachment for ground-engaging pads of stabilizer arms of material-handling apparatus as set forth in claim 3, and including a pair of lip members on said plate extending along opposite sides of said opening, said second pin is adapted to be supported on said pair of lip members.

* * * * *